US010752848B2

(12) United States Patent
Verstraete et al.

(10) Patent No.: US 10,752,848 B2
(45) Date of Patent: Aug. 25, 2020

(54) PROCESS INTEGRATING TWO-STAGE HYDROCRACKING AND A HYDROTREATMENT PROCESS

(71) Applicant: IFP Energies nouvelles, Rueil-Malmaison (FR)

(72) Inventors: Jan Verstraete, Lyons (FR); Elodie Tellier, Lyons (FR); Thomas Plennevaux, Lyons (FR); Emmanuelle Guillon, Vourles (FR); Anne Claire Pierron, Saint Maurice l'exil (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 58 days.

(21) Appl. No.: 16/006,300

(22) Filed: Jun. 12, 2018

(65) Prior Publication Data

US 2018/0362864 A1 Dec. 20, 2018

(30) Foreign Application Priority Data

Jun. 16, 2017 (FR) ..... 17 55489

(51) Int. Cl.
*C10G 67/02* (2006.01)
*C10G 45/02* (2006.01)
(Continued)

(52) U.S. Cl.
CPC ..... *C10G 67/02* (2013.01); *C10G 45/02* (2013.01); *C10G 47/00* (2013.01); *C10G 65/12* (2013.01);
(Continued)

(58) Field of Classification Search
CPC ..... C10G 67/02; C10G 2300/4081; C10G 2300/1059; C10G 2300/1074;
(Continued)

(56) References Cited

U.S. PATENT DOCUMENTS 8,110,091 B2 2/2012 Chapus
8,158,070 B1 4/2012 Wieber
(Continued)

FOREIGN PATENT DOCUMENTS

FR 2907459 B1 10/2012
WO 2008081100 A2 7/2008
WO 2016073289 A1 5/2016

OTHER PUBLICATIONS

FR Appl. No. 1755489 search Report dated Jan. 26, 2018.

*Primary Examiner* — Prem C Singh
*Assistant Examiner* — Juan C Valencia
(74) *Attorney, Agent, or Firm* — Millen, White, Zelano and Branigan, P.C.

(57) ABSTRACT

A process for hydrocracking hydrocarbon-containing VD feedstocks allowing the improved production of middle distillates: a) hydrocracking of feedstocks in hydrogen and at least one hydrocracking catalyst, b) gas/liquid separation of effluent originating from a) producing a liquid effluent and a gaseous effluent with hydrogen, c) comprising the gaseous effluent before recycling into hydrocracking a), d) fractionation of liquid effluent into at least one effluent of converted hydrocarbon-containing products having boiling points less than 340° C. and an unconverted liquid fraction having a boiling point greater than 340° C., e) hydrocracking unconverted liquid fraction from d), in hydrogen and a hydrocracking catalyst, f) hydrotreating effluent from e) in a mixture with a hydrocarbon-containing gas-oil liquid feedstock having at least 95% by weight of compounds boiling at a boiling point between 150 and 400° C., hydrotreating f) operating in hydrogen and with at least one hydrotreating catalyst.

17 Claims, 1 Drawing Sheet

(51) Int. Cl.
*C10G 65/12* (2006.01)
*C10G 47/00* (2006.01)

(52) U.S. Cl.
CPC ..... *C10G 2300/1059* (2013.01); *C10G 2300/1074* (2013.01); *C10G 2300/4081* (2013.01)

(58) Field of Classification Search
CPC ..... C10G 65/12; C10G 47/00; C10G 45/02; C10G 49/26; C10G 49/00; C10G 47/36; C10G 67/00
See application file for complete search history.

(56) References Cited

U.S. PATENT DOCUMENTS

| | | | | |
|---|---|---|---|---|
| 2006/0131212 | A1* | 6/2006 | Dahlberg ..... | C10G 65/10 208/59 |
| 2012/0080357 | A1 | 4/2012 | Novak | |
| 2013/0112595 | A1 | 5/2013 | Al-Abdulal | |
| 2014/0262942 | A1 | 9/2014 | Arora | |
| 2016/0298038 | A1* | 10/2016 | Umansky ..... | C10G 67/02 |

* cited by examiner

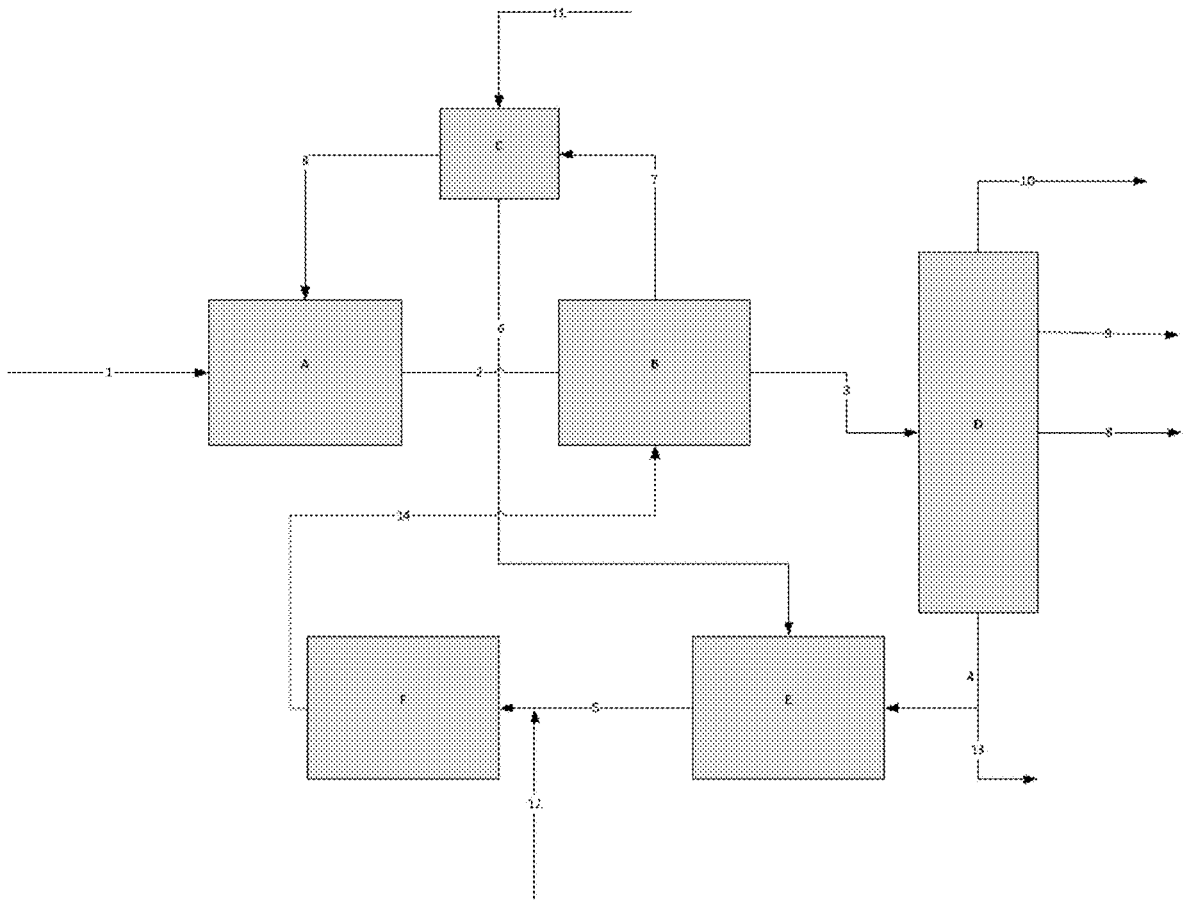
11
C
8
7
10
A
6
B
9
1
2
3
D
8
14
4
F
5
E
13
12

PROCESS INTEGRATING TWO-STAGE HYDROCRACKING AND A HYDROTREATMENT PROCESS

The hydrocracking of heavy petroleum cuts is a key refining process that makes it possible to produce, starting from surplus heavy feedstocks for which there is little demand for upgrading, lighter fractions such as gasolines, jet fuels, and light gas oils required by the refiner for adapting production to demand. Certain hydrocracking processes make it possible to also obtain a highly purified residue that can constitute excellent bases for oils, or a feedstock that can be easily upgraded in a catalytic cracking unit for example. One of the effluents particularly sought by the hydrocracking process is the middle distillate (fraction that contains the gas oil cut and the kerosene cut).

The hydrocracking process for vacuum distillates or VDs makes it possible to produce light cuts (gas oil, kerosene, naphthas, etc.) that are more able to be upgraded than the VD itself. This catalytic process does not make it possible to completely transform the VD into light cuts. After fractionation, a more or less significant proportion therefore remains of the unconverted VD fraction called UCO or unconverted oil. In order to increase conversion, this unconverted fraction can be recycled to the inlet of the hydrotreating reactor or to the inlet of the hydrocracking reactor. Recycling the unconverted fraction at the inlet of the hydrotreating reactor or at the inlet of the hydrocracking reactor makes it possible at the same time to increase conversion, and also to increase the selectivity for gas oil and kerosene. Another way of increasing conversion while maintaining selectivity is to add a conversion or hydrocracking reactor on the loop for recycling the unconverted fraction to the high-pressure separation section. This reactor and the associated recycling constitutes a second stage of hydrocracking. As this reactor is situated downstream of the fractionation section, it operates with little sulphur ($H_2S$) and little nitrogen, which makes it possible to optionally use catalysts that are less sensitive to the presence of sulphur while increasing the selectivity of the process.

In fact, two-stage hydrocracking includes a first stage the purpose of which, as in the "single-stage" process, is to carry out hydrorefining of the feedstock but also to achieve conversion thereof generally of the order of 30 to 70%. The effluent originating from the first stage then undergoes fractionation (distillation), the purpose of which is to separate the conversion products from the unconverted fraction. In the second stage of a 2-stage hydrocracking process, only the fraction of the feedstock that is not converted during the first stage is treated. This separation allows a two-stage hydrocracking process to be more selective for diesel than a single-stage process having an equivalent overall conversion rate. In fact, the intermediate separation of the conversion products avoids "over-cracking" thereof to naphtha and gas in the second stage on the hydrocracking catalyst. Moreover, it should be noted that the unconverted fraction of the feedstock treated in the second stage generally contains a very low level of both $NH_3$ and organic nitrogen-containing compounds, in general less than 20 ppm by weight or even less than 10 ppm by weight.

The process for the hydrodesulphurization of gas oils makes it possible to reduce the quantity of sulphur contained in a gas oil cut while minimizing conversion of the feedstock to lighter products (gas, naphtha). The hydrodesulphurization feedstock can be constituted by straight run gas oil or gas oil originating from the atmospheric fractionation of a crude oil, Light Vacuum Gas Oil or light vacuum distillates, LCO or distillate originating from a conversion process (FCC, coker, etc.) a gas oil feedstock originating from biomass conversion (esterification, for example), alone or in a mixture, for example. The partial pressure of hydrogen required for this process is lower than the partial pressure of hydrogen in the hydrocracker. It is common for these two processes to be present in one and the same refinery without being integrated. However, they are based on very similar process layouts, constituted by a feedstock furnace, fixed-bed reactors, hydrogen recycle compressors and more or less complex high-pressure separation sections.

The invention consists of integrating a two-stage hydrocracking process with a gas oil hydrodesulphurization process, using at least a part of the reactor of the second hydrocracking stage for desulphurizing the gas oil feedstock in a mixture with the unconverted fraction or UCO.

The applicant's research studies have led him to the discovery that the co-treatment of the mixture constituted by the effluent from the second stage of a two-stage hydrocracking process treating a feedstock of VD type, with a feedstock of gas oil type, in a hydrotreating stage allows, with respect to the co-treatment of a feedstock of VGO type and of a feedstock of gas oil type, directly in a mixture in a two-stage hydrocracking process:

- limiting the cracking of the feedstock of gas oil type in the hydrotreating stage and maximizing the selectivity of the process,
- limiting the concentration of nitrogen and sulphur in the hydrotreating stage of the feedstock of gas oil type in a mixture with the effluent from the second hydrocracking stage, which optimizes said stage,
- in addition, desulphurizing the feedstock of gas oil type, minimizing the formation of heavy polyaromatic products (HPNA), which makes it possible to limit purging at the intake of the second hydrocracking stage and thus to increase the conversion of the process, and
- in addition, desulphurizing the feedstock of gas oil type, converting the unconverted part originating from the second hydrocracking stage e), making it possible to reduce the quantity of catalyst used in said hydrocracking stage e), at iso-conversion per pass of the stage constituted by the combination of the second hydrocracking stage e) and the hydrotreating stage f).

The process according to the invention also allows, with respect to the processes dedicated to two-stage hydrocracking of VD and hydrodesulphurization of the gas oils operating separately:

- reducing the initial investment and consumption of catalyst in the second hydrocracking stage e).

SUMMARY OF THE INVENTION

The present invention relates to a two-stage hydrocracking process for a hydrocarbon-containing feedstock of vacuum distillate type in which all of the effluent originating from the second hydrocracking stage e) is co-treated in a hydrotreating stage f) situated downstream of said hydrocracking stage e), in a mixture with a hydrocarbon-containing liquid feedstock of gas oil type, different from said effluent originating from the second hydrocracking stage e).

In particular, the present invention relates to a hydrocracking process for hydrocarbon-containing feedstocks containing at least 20% volume and preferably at least 80% volume compounds boiling above 340° C., said process comprising at least the following stages:

a) Hydrocracking of said feedstocks, operating in the presence of hydrogen and at least one hydrocracking catalyst, at a temperature comprised between 250 and 480° C. under a pressure comprised between 2 and 25 MPa, at a space velocity comprised between 0.1 and 6 h−1 and at a quantity of hydrogen introduced such that the volume ratio litre of hydrogen/litre of hydrocarbon is comprised between 100 and 2000 L/L, b) Gas/liquid separation of the effluent originating from stage a) in order to produce a liquid effluent and a gaseous effluent comprising at least hydrogen, c) Sending the gaseous effluent comprising at least hydrogen into a compression stage before it is recycled into at least the hydrocracking stage a), d) Fractionating the liquid effluent into at least one effluent comprising the converted hydrocarbon-containing products having boiling points less than 340° C. and an unconverted liquid fraction having a boiling point greater than 340° C., e) Hydrocracking of said unconverted liquid fraction originating from stage d) operating in the presence of hydrogen and a hydrocracking catalyst, at a temperature comprised between 250 and 480° C. under a pressure comprised between 2 and 25 MPa, at a space velocity comprised between 0.1 and 6 h−1 and at a quantity of hydrogen introduced such that the volume ratio litre of hydrogen/litre of hydrocarbon is comprised between 100 and 2000 L/L, f) Hydrotreating the effluent originating from stage e) in a mixture with a hydrocarbon-containing liquid feedstock comprising at least 95% by weight of compounds boiling at a boiling point comprised between 150 and 400° C., said hydrotreating stage f) operating in the presence of hydrogen and at least one once hydrotreating catalyst, at a temperature comprised between 200 and 390° C., under a pressure comprised between 2 and 16 MPa, at a space velocity comprised between 0.2 and 5 h−1 and at a quantity of hydrogen introduced such that the volume ratio litre of hydrogen/litre of hydrocarbon is comprised between 100 and 2000 L/L.

An advantage of the present invention is to provide a process integrating a two-stage hydrocracking process with a hydrodesulphurization process of gas oils making it possible to limit the cracking of the feedstock of gas oil type in the hydrotreating stage and to maximize the selectivity and the yields of middle distillates of the process.

reducing the initial investment and consumption of catalyst in the second hydrocracking stage e).

Another advantage of the present invention is to provide a process making it possible, by implementing co-treatment of the effluent originating from the hydrocracking stage e) in a mixture with a hydrocarbon-containing liquid feedstock of gas oil type in a hydrotreating stage f) downstream of the hydrocracking stage e), additionally making it possible to desulphurize the hydrocarbon-containing liquid feedstock of gas oil type and to convert the unconverted part of the effluent originating from the hydrocracking stage e), which makes it possible to reduce the quantity of catalyst used in said hydrocracking stage e), at iso-conversion per pass of the stage constituted by the combination of the second hydrocracking stage e) and of the hydrotreating stage f).

Another advantage of the present invention is to provide a process making it possible, by implementing said co-treatment, additionally making it possible to desulphurize the hydrocarbon-containing liquid feedstock of gas oil type, and to minimize the formation of heavy polyaromatic products (HPNA). In fact, HPNAs form progressively during recycling thereof in the second hydrocracking stage. Implementing hydrotreating stage f) downstream of the hydrocracking stage e) makes it possible to limit the increase in HPNAs by hydrogenating the precursors of said HPNAs, i.e. HPNAs of low molecular weight).

Another advantage of the present invention is to provide a process which by the integration of two processes makes it possible to reduce the operating costs and to reduce the consumption of catalyst in the second hydrocracking stage.

DETAILED DESCRIPTION OF THE INVENTION

According to the invention, the process comprises a hydrocracking stage a) of said feedstocks operating in the presence of hydrogen and at least one hydrocracking catalyst, at a temperature comprised between 250 and 480° C., under a pressure comprised between 2 and 25 MPa, at a space velocity comprised between 0.1 and 6 h−1 and at a quantity of hydrogen introduced such that the volume ratio litre of hydrogen/litre of hydrocarbon is comprised between 100 and 2000 L/L.

The operating conditions such as temperature, pressure, hydrogen recycle ratio, hourly space velocity, can be very variable depending on the nature of the feedstock, the quality of the required products and the facilities available to the refiner.

Preferably, the hydrocracking stage a) according to the invention operates at a temperature comprised between 320 and 450° C., very preferably between 330 and 435° C., under a pressure comprised between 3 and 20 MPa, and very preferably between 6 and 20 MPa, at a space velocity comprised between 0.2 and 4 h−1, very preferably between 0.3 and 5 h−1 and at a quantity of hydrogen introduced such that the volume ratio litre of hydrogen/litre of hydrocarbon is comprised between 200 and 2000 L/L.

These operating conditions used in stage a) of the process according to the invention generally make it possible to reach conversions per pass, in products having boiling points less than 340° C., and better less than 370° C., greater than 15% by weight and even more preferably comprised between 20 and 95% by weight.

According to the invention, the hydrocarbon-containing feedstocks treated in the process according to the invention and sent into stage a) are selected from the hydrocarbon-containing feedstocks containing at least 20% by volume and preferably at least 80% by volume of compounds boiling above 340° C. and preferably between 370 and 580° C. (i.e. corresponding to compounds containing at least 15 to 20 carbon atoms).

Said hydrocarbon-containing feedstocks can advantageously be selected from VGOs (vacuum gas oils) or vacuum distillates (VDs) such as for example the gas oils originating from direct distillation of crude or conversion units such as FCC, coker or visbreaking as well as feedstocks originating from units for extracting aromatics from the lubricating oil bases or originating from the solvent dewaxing of lubricating oil bases, or also from distillates originating from desulphurization or hydroconversion of ATRs (atmospheric residues) and/or VRs (vacuum residues), or also the feedstock can advantageously be a deasphalted oil, or feedstocks originating from biomass or also any mixture of the abovementioned feedstocks. The above list is not limitative. In general, said feedstocks have an initial boiling point greater than 340° C., and preferably greater than 370° C.

Said hydrocarbon-containing feedstocks can contain heteroatoms such as sulphur and nitrogen. The nitrogen content is usually comprised between 1 and 8000 ppm by weight, more generally between 200 and 5000 ppm by weight, and the sulphur content between 0.01 and 6% by weight, more generally between 0.2 and 5% and even more preferably, between 0.5 and 4% by weight.

Said feedstock treated in the process according to the invention and sent into stage a) may contain metals. The cumulative nickel and vanadium content of the feedstocks treated in the processes according to the invention is preferably less than 1 ppm by weight.

The asphaltenes content is generally less than 3000 ppm by weight, preferably less than 1000 ppm by weight, even more preferably less than 200 ppm by weight.

In the case where the feedstock contains compounds of the resins and/or asphaltenes type, it is advantageous to first pass the feedstock over a bed of catalyst or adsorbent that is different from the hydrocracking or hydrotreating catalyst.

According to the invention, the hydrocracking stage a) operates in the presence of at least one hydrocracking catalyst. Preferably, the hydrocracking catalyst is selected from the conventional hydrocracking catalysts known to a person skilled in the art.

The hydrocracking catalysts used in the hydrocracking processes are all of the bifunctional type combining an acid function with a hydrogenating function. The acid function is provided by supports with large surface areas (generally 150 to 800 $m^2 \cdot g-1$) having surface acidity, such as halogenated alumina (chlorinated or fluorinated in particular), the combinations of oxides of boron and aluminium, amorphous silica-aluminas and zeolites. The hydrogenating function is provided either by one or more metals of Group VIII of the periodic table of elements, or by a combination of at least one metal of Group VIB of the periodic table and at least one metal of Group VIII.

Preferably, the hydrocracking catalyst or catalysts comprise a hydrogenating function comprising at least one metal of Group VIII selected from iron, cobalt, nickel, ruthenium, rhodium, palladium and platinum, and preferably cobalt and nickel and/or at least one metal of Group VIB selected from chrome, molybdenum and tungsten, alone or in a mixture and preferably from molybdenum and tungsten.

Preferably, the Group VIII metal content in the hydrocracking catalyst or catalysts is advantageously comprised between 0.5 and 15% by weight and preferably between 2 and 10% by weight, the percentages being stated in percentage by weight of oxides.

Preferably, the Group VIB metal content in the hydrocracking catalyst or catalysts is advantageously comprised between 5 and 25% by weight and preferably between 15 and 22% by weight, the percentages being stated in terms of the percentage by weight of oxides.

The catalyst or catalysts can also optionally comprise at least one promoter element deposited on the catalyst and selected from the group formed by phosphorous, boron and silicon, optionally at least one Group VIIA element (chlorine, fluorine preferred), and optionally at least one element of Group VIIB (manganese preferred), optionally at least one Group VB element (niobium preferred).

Preferably, the hydrocracking catalyst or catalysts comprise an acid function selected from alumina, silica-alumina and zeolites, preferably selected from the Y zeolites and preferably selected from silica-alumina and the zeolites.

A preferred catalyst comprises and preferably is constituted by at least one metal of Group VI and/or at least one non-noble metal of Group VIII, and a Y zeolite and an alumina binder.

An even more preferred catalyst comprises and is preferably constituted by nickel, molybdenum, a Y zeolite and alumina.

Another preferred catalyst comprises and is preferably constituted by nickel, tungsten and alumina or silica-alumina.

In stage a) of the process according to the invention, conversion, during the first stage, to products having boiling points less than 340° C., and better, less than 370° C., is greater than 20% and preferably greater than 30% and even more preferably comprised between 30 and 80% and preferably between 40 and 60%.

The hydrocarbon-containing feedstocks treated in the process according to the invention and sent into stage a) can optionally be sent into a hydrotreating stage before being sent into the hydrocracking stage a) of said process. In the optional hydrotreating stage, said feedstocks are advantageously desulphurized and denitrogenized.

Preferably, said hydrotreating stage is advantageously implemented under conventional hydrorefining conditions and in particular in the presence of hydrogen and a hydrotreating catalyst and at a temperature comprised between 200 and 400° C., under a pressure comprised between 2 and 16 MPa, at a space velocity comprised between 0.2 and 5 h−1 and at a quantity of hydrogen introduced such that the volume ratio litre of hydrogen/litre of hydrocarbon is comprised between 100 and 2000 L/L.

Conventional hydrotreating catalysts can advantageously be used, preferably containing at least one amorphous support and at least one hydrogenating-dehydrogenating element selected from at least one non-noble element of Group VIB or Group VIII, and most often at least one element of Group VIB and at least one non-noble element of Group VIII.

Preferably, the amorphous support is alumina or silica-alumina.

Preferred catalysts are selected from the catalysts NiMo on alumina and NiMo or NiW on silica-alumina.

The effluent originating from the hydrotreating stage and entering into the hydrocracking stage a) comprises a nitrogen content preferably less than 300 ppm by weight and preferably less than 50 ppm by weight.

In the case where a hydrotreating stage is implemented, the hydrotreating stage and the hydrocracking stage a) can advantageously be carried out in one and the same reactor or in different reactors. In the case where they are carried out in one and the same reactor, the reactor comprises several catalyst beds, the first catalyst beds comprising the hydrotreating catalyst or catalysts and the following catalyst beds comprising the hydrocracking catalyst or catalysts.

According to the invention, the process comprises a stage b) of gas/liquid separation of the effluent originating from stage a) for producing a liquid effluent and a gaseous effluent comprising at least hydrogen.

Preferably, the gas/liquid separation stage b) is implemented in a high temperature and high-pressure separator operating at a temperature comprised between 50 and 450° C., preferentially between 100 and 400° C., even more preferentially between 200 and 300° C., and a pressure corresponding to the outlet pressure of a) reduced by the head losses.

According to the invention, the process comprises a stage c) of sending the gaseous effluent comprising at least hydrogen into a compression stage before it is recycled into at least the hydrocracking stage a). This stage is necessary in order to allow the recycling of the gas upstream, i.e. in the hydrocracking stage a), thus at a higher pressure.

The gaseous effluent comprising at least hydrogen can advantageously be mixed with makeup hydrogen before or after its introduction into the compression stage c), preferably by means of a makeup hydrogen compressor.

According to a variant, a part of the gaseous effluent comprising at least compressed hydrogen can also advantageously be sent into the hydrocracking e) and/or hydrotreating f) stages.

According to the invention, the process comprises a stage d) of fractionation of the liquid effluent originating from stage a) into at least one effluent comprising the converted hydrocarbon-containing products having boiling points less than 340° C., preferably less than 370° C. and preferably less than 380° C. and an unconverted liquid fraction having a boiling point greater than 340° C., preferably greater than 370° C. and preferably greater than 380° C., also called UCO "unconverted oil".

Preferably, said fractionation stage d) comprises a first separation stage comprising a separation means such as for example a disengager or steam stripper preferably operating at a pressure comprised between 0.5 and 2 MPa, the purpose of which is to carry out a separation of hydrogen sulphide ($H_2S$) from at least one hydrocarbon-containing effluent produced during the hydrocracking stage a). The hydrocarbon-containing effluent, originating from this first separation, can advantageously undergo atmospheric distillation, and in certain cases the combination of atmospheric distillation and vacuum distillation. The purpose of the distillation is to carry out a separation between the converted hydrocarbon-containing products, i.e. generally having boiling points less than 340° C., preferably less than 370° C. and preferably less than 38° C., and an unconverted (UCO) liquid fraction (residue).

According to another variant, the fractionation stage is constituted by an atmospheric distillation column only.

The converted hydrocarbon-containing products having boiling points less than 340° C., preferably less than 370° C. and even more preferably less than 380° C. are advantageously distilled at atmospheric pressure in order to obtain several converted fractions with a boiling point of 340° C. at most, and preferably a $C_1$-$C_4$ light gas fraction, at least one gasoline fraction and at least one kerosene and gas oil middle distillates fraction.

The liquid fraction, unconverted residue, (UCO) containing products the boiling point of which is greater than 340° C., preferably greater than 370° C. and preferably greater than 380° C. and originating from distillation is at least partly and preferably entirely introduced into the second hydrocracking stage e) of the process according to the invention.

Purging can advantageously be carried out on the residue of the liquid fraction in order to avoid the accumulation of heavy polyaromatic products (HPNA) present in the loop for recycling heavy fractions. In fact, HPNAs form progressively during recycling thereof in the second hydrocracking stage and recycling these heavy aromatic elements in the loop of the second hydrocracking stage e) results in increasing the molecular weight thereof. The presence of HPNAs in said recycle loop leads over time to a significant loss of feedstock. Purging is therefore necessary in order to limit the accumulation of these HPNA products.

According to the invention, the process comprises a hydrocracking stage e) of said unconverted liquid fraction originating from stage d), optionally purged, operating in the presence of hydrogen and of a hydrocracking catalyst, at a temperature comprised between 250 and 480° C., under a pressure comprised between 2 and 25 MPa, at a space velocity comprised between 0.1 and 6 h−1 and at a quantity of hydrogen introduced such that the volume ratio litre of hydrogen/litre of hydrocarbon is comprised between 100 and 2000 L/L.

Preferably, the hydrocracking stage e) according to the invention operates at a temperature comprised between 320 and 450° C., very preferably between 330 and 435° C., under a pressure comprised between 3 and 20 MPa, and very preferably between 9 and 20 MPa, at a space velocity comprised between 0.2 and 3 h−1, and at a quantity of hydrogen introduced such that the volume ratio litre of hydrogen/litre of hydrocarbon is comprised between 100 and 2000 L/L.

These operating conditions used in stage a) of the process according to the invention generally make it possible to achieve conversions per pass, in products having boiling points less than 340° C., preferably less than 370° C. and very preferably less than 380° C., greater than 15% by weight and even more preferably comprised between 20 and 80% by weight. Nevertheless, the conversion per pass in stage e) is kept low in order to maximize the selectivity of the process for product having boiling points comprised between 150 and 370° C. (middle distillates). Conversion per pass is limited by the use of a high recycle ratio on the loop of the second hydrocracking stage. This rate is defined as the ratio between the supply flow rate of stage e) and the feedstock flow rate of stage a) preferentially this ratio is comprised between 0.2 and 4, preferably between 0.5 and 2.

According to the invention, the hydrocracking stage e) operates in the presence of at least one hydrocracking catalyst. Preferably, the hydrocracking catalyst of the second stage is selected from the conventional hydrocracking catalysts known to a person skilled in the art. The hydrocracking catalyst used in said stage e) can be identical to or different from that used in stage a), and preferably different.

The hydrocracking catalysts used in the hydrocracking processes are all of the bifunctional type combining an acid function with a hydrogenating function. The acid function is provided by supports with large surface areas (generally 150 to 800 $m^2 \cdot g-1$) having a surface acidity, such as halogenated alumina (chlorinated or fluorinated in particular), combinations of boron and aluminium oxides, amorphous silica-aluminas and zeolites. The hydrogenating function is provided either by one or more metal(s) of Group VIII of the periodic table of elements, or a combination of at least one metal of Group VIB of the periodic table and at least one metal of Group VIII.

Preferably, the hydrocracking catalyst or catalysts used in stage e) comprise a hydrogenating function comprising at least one Group VIII metal selected from iron, cobalt, nickel, ruthenium, rhodium, palladium and platinum and preferably cobalt and nickel and/or at least one Group VIB metal selected from chromium, molybdenum and tungsten, alone or in a mixture and preferably from molybdenum and tungsten.

Preferably, the Group VIII metal content in the hydrocracking catalyst or catalysts is advantageously comprised between 0.5 and 15% by weight and preferably between 2 and 10% by weight, the percentages being stated in terms of the percentage by weight of oxides.

Preferably, the Group VIB metal content in the hydrocracking catalyst or catalysts is advantageously comprised between 5 and 25% by weight and preferably between 15 and 22% by weight, the percentages being stated in terms of the percentage by weight of oxides.

The catalyst or catalysts used in stage e) can also optionally comprise at least one promoter element deposited on the catalyst and selected from the group formed by phosphorous, boron and silicon, optionally at least one element of Group VIIA (chlorine, fluorine preferred), and optionally at least one element of Group VIIB (manganese preferred), optionally at least one element of Group VB (niobium preferred).

Preferably, the hydrocracking catalyst or catalysts used in stage e) comprise an acid function selected from alumina, silica-alumina and zeolites, preferably selected from the Y zeolites and preferably selected from silica-alumina and zeolites.

A preferred catalyst used in stage e) comprises and preferably is constituted by at least one metal of Group VI and/or at least one non-noble metal of Group VIII, and a Y zeolite and alumina.

An even more preferred catalyst comprises and is preferably constituted by nickel, molybdenum, a Y zeolite and alumina.

Another preferred catalyst comprises and is preferably constituted by nickel, tungsten and alumina or silica-alumina.

According to the invention, the process comprises a hydrotreating stage f) of the effluent originating from stage e) in a mixture with a hydrocarbon-containing liquid feedstock comprising at least 95% by weight of compounds boiling at a boiling point comprised between 150 and 400° C., preferably between 150 and 380° C. and very preferably comprised between 200 and 380° C.

All of the effluent originating from stage e) is thus co-treated in a hydrotreating stage f) in a mixture with a hydrocarbon-containing liquid feedstock different from said effluent originating from the second hydrocracking stage e).

Said hydrocarbon-containing liquid feedstock can advantageously be a feedstock originating from a unit external to said process according to the invention or a flow internal to said process according to the invention, said internal flow being different from said effluent originating from the second hydrocracking stage e). Preferably, said hydrocarbon-containing liquid feedstock is a feedstock originating from a unit external to said process according to the invention.

Preferably, said hydrocarbon-containing feedstock treated in stage f) in a mixture with the effluent originating from stage e) is advantageously selected from the hydrocarbon-containing liquid feedstocks originating from direct distillation of a crude (or straight run) oil and preferably selected from straight run gas oil, light vacuum gas oil (LVGO) or light vacuum distillate, and the hydrocarbon-containing liquid feedstocks originating from a coking unit, preferably coker gas oil, from a visbreaking unit, from a steam cracking unit and/or from a fluid catalytic cracking unit, preferably LCOs (light cycle oils) or light gas oils originating from a catalytic cracking unit and a gas oil feedstock originating from biomass conversion (esterification for example), said feedstocks being able to be used alone or in a mixture.

Said hydrocarbon-containing liquid feedstock can also advantageously be a hydrocarbon-containing liquid feedstock originating from an ebullating bed conversion unit of the H-Oil type.

The proportion of said different hydrocarbon-containing liquid feedstock co-treated with the effluent originating from stage e) in stage f) represents between 20% and 80% by weight of the total mass of the total liquid mixture at the inlet of the hydrotreating stage f), preferentially between 30% and 70% by weight and even more preferentially between 40% and 60% by weight.

The treatment of the effluent originating from stage e) in a mixture with said hydrocarbon-containing liquid feedstock in a hydrotreating stage f), downstream of the hydrocracking stage e), also makes it possible to desulphurize said hydrocarbon-containing liquid feedstock, to minimize the formation of heavy polyaromatic products (HPNA). Minimizing the formation of the HPNAs makes it possible to minimize the purging required on the liquid fraction, unconverted residue (UCO), originating from stage d) and thus to increase the overall conversion of the process. The purge rate, corresponding to the ratio between the mass flow rate of the purge flow and the mass flow rate of the hydrocarbon-containing feedstock entering into the process according to the invention is advantageously comprised between 0 and 2%.

According to the invention, said stage f) operates in the presence of hydrogen and at least one hydrotreating catalyst, at a temperature comprised between 200 and 390° C., under a pressure comprised between 2 and 16 MPa, at a space velocity comprised between 0.2 and 5 h−1 and at a quantity of hydrogen introduced such that the volume ratio litre of hydrogen/litre of hydrocarbon is comprised between 100 and 2000 L/L.

Conventional hydrotreating catalysts can advantageously be used in said stage f), preferably containing at least one amorphous support and at least one hydrogenating-dehydrogenating element selected from at least one non-noble Group VIB or Group VIII element, and preferably at least one Group VIB element and at least one non-noble Group VIII element.

Preferably, the amorphous support is of alumina or silica-alumina.

Preferred catalysts are selected from NiMo or CoMo catalysts on alumina and NiMo or NiW on silica-alumina.

Surprisingly, the hydrotreating stage f) also makes it possible to convert the unconverted part of the effluent originating from the hydrocracking stage e), which makes it possible to reduce the quantity of catalyst used in the hydrocracking stage e), at iso-conversion per pass of the stage constituted by the combination of the hydrocracking stage e) and the hydrotreating stage f). Moreover, the presence of the hydrotreating stage f) increases the quantity of hydrogen in the recycling of the unconverted liquid fraction having a boiling point greater than 340° C. (UCO) to the hydrocracking stage e), facilitating conversion thereof in said stage e) and thus further reducing the quantity of catalyst required in said stage (for an equal lifetime).

The hydrocracking stage e) and the hydrotreating stage f) can advantageously be carried out in one and the same reactor or in different reactors. In the case where they are carried out in one and the same reactor, an intermediate injection of the hydrocarbon-containing liquid feedstock is advantageously implemented between the different catalytic beds. In this case, the reactor comprises several catalyst beds, the first catalyst beds comprising the hydrocracking catalyst or catalysts and the following catalyst beds comprising the hydrotreating catalyst or catalysts.

The hydrotreating stage f) advantageously operates at a pressure greater than the pressure of the effluent originating from the hydrocracking stage a).

Thus, in a first particular embodiment, at least a part, and preferably all of the effluent originating from the hydrotreating stage f) can advantageously be recycled into the gas/liquid separation stage b).

This configuration makes it possible to use a single compressor on the hydrogen recycle loop. In fact, in this case, recycling of gas containing hydrogen to stage f) is provided by the same compressor as for the recycling of gas containing hydrogen to stage a).

In a second particular embodiment, at least a part and preferably all of the effluent originating from the hydrotreating stage f) can advantageously be sent into a second gas/liquid separation stage in order to produce a liquid effluent and a gaseous effluent comprising at least hydrogen.

Preferably, said second gas/liquid separation stage is implemented in a high temperature, high-pressure separator operating at a pressure and a temperature compatible with the outlet temperature and pressure of stage f). Said second separation stage is preferentially implemented at a temperature comprised between 200 and 390° C., under a pressure comprised between 2 and 16 MPa.

In this case, the liquid effluent originating from the second separation stage can advantageously be recycled into the hydrocracking stage e) and/or into the hydrotreating stage f).

According to a variant, the gaseous effluent comprising at least hydrogen originating from the second separation stage can advantageously be sent into the compression stage c). In this case, the process implements two gas/liquid separators and a single compressor on the hydrogen recycle loop, as well as a single makeup hydrogen compressor, which reduces the cost of the facility.

According to another variant, the gaseous effluent comprising at least hydrogen originating from the second separation stage can be sent into a second compression stage before its recycling into stage e) and/or into stage f).

DESCRIPTION OF THE FIGURE

FIG. 1 shows a particular embodiment of the invention.

The hydrocarbon-containing feedstock of the VD or VGO type (1) enters a hydrocracking section A of stage a) corresponding to the first hydrocracking stage. Said section can comprise one or two hydrocracking reactors R1 and/or R2 (not shown in the FIGURE). The effluent (2) originating from stage a) is sent into a gas/liquid separator B of stage b) making it possible to isolate a gaseous flow comprising hydrogen (7). The gaseous effluent (7) is sent into a recycling compressor C, it is mixed with a makeup hydrogen flow (11) then recycled into the hydrocracking reactor via the flow (8).

The liquid effluent (3) originating from the separator B supplies a fractionation column D of stage d).

An effluent comprising light cuts (10), a gasoline cut (9) and a middle distillate cut (8) corresponding to gas oil and kerosene are separated in the fractionation column. An unconverted liquid fraction cut called UCO (unconverted oil) (12) is also separated then sent via the flow (4) into a second hydrocracking section E of stage e). Said hydrocracking section E comprises a hydrocracking reactor R3 (not shown in the FIGURE). Purging (13) is carried out on the flow of the unconverted liquid fraction originating from stage d).

A hydrocarbon-containing liquid feedstock (12) of gas oil type is injected downstream of the hydrocracking section of the UCO E of stage e) and is treated in a hydrodesulphurization section F of stage f) in a mixture with the effluent originating from the hydrocracking section E, i.e. the hydrocracked UCO (5).

The examples illustrate the invention but without however limiting its scope.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 17/55.489, filed Jun. 16, 2017 are incorporated by reference herein.

EXAMPLES

Example 1a: Comparative: Dedicated Processes

This example is a comparative basic example in which the processes for hydrocracking VD or VGO and for hydrodesulphurization of gas oils (GO) are implemented in two dedicated separate processes.

The hydrocracking unit treats a vacuum gas oil feedstock (VGO) and the HDS gas oil unit treats a gas oil feedstock (GO) described in Table 1:

TABLE 1

| Type | | VGO | GO |
|---|---|---|---|
| Flow rate | t/h | 49 | 51 |
| Density | $t/m^3$ | 0.92 | 0.83 |
| TBP IP | ° C. | 300 | 47 |
| TBP FP | ° C. | 552 | 416 |
| S | wt % | 2.18 | 0.68 |
| N | wt ppm | 1800 | 210 |

Main Operating Conditions

Hydrotreating of Gas Oil

The GO feedstock is injected into a preheating stage then into a hydrotreating reactor under the following conditions stated in Table 2:

TABLE 2

| Reactor | | HDS GO |
|---|---|---|
| Temperature | ° C. | 336 |
| $H_2$ partial pressure | MPa | 4 |
| Catalyst | | CoMo on alumina HR1246 |
| HSV | h−1 | 1.04 |

The catalyst used is a CoMo catalyst on alumina of the HR1246 type marketed by the company Axens.

The HDS gas oil process is then composed of a heat recovery system followed by high-pressure separation including a recycling compressor and making it possible to separate on the one hand hydrogen, the sulphur- and nitrogen-containing compounds and on the other hand the desulphurized effluent supplying a steam stripper in order to separate hydrogen sulphide and naphtha.

The final gas oil effluent has the following properties stated in Table 3:

TABLE 3

| Type | | GO |
|---|---|---|
| Flow rate | t/h | 46 |
| Density | $t/m^3$ | 0.82 |
| TBP IP | ° C. | 151 |
| TBP FP | ° C. | 450 |
| S | Wt ppm | 10.00 |
| N | Wt ppm | 2 |

Two-Stage Hydrocracker

The VGO feedstock is injected into a preheating stage then into a hydrotreating reactor under the following conditions stated in Table 4:

TABLE 4

| Reactor | | R1 |
|---|---|---|
| Temperature | ° C. | 385 |
| $H_2$ partial pressure | MPa | 14 |
| Catalyst | | CoMo on alumina HR1058 |
| HSV | h−1 | 1.67 |

The catalyst used is a CoMo catalyst on alumina of the HR1058 type marketed by the company Axens.

The effluent from this reactor is then mixed with a hydrogen flow in order to be cooled then is injected into a second reactor called hydrocracking reactor R2 operating under the conditions in Table 5:

TABLE 5

| Reactor | | R2 |
|---|---|---|
| Temperature | ° C. | 390 |
| $H_2$ partial pressure | MPa | 12.5 |
| Catalyst | | Metal on zeolite HYK742 |
| HSV | h−1 | 3 |

The catalyst used is a metal catalyst on zeolite of the HYK742 type marketed by the company Axens.

R1 and R2 constitute the first hydrocracker stage, the effluent R2 is then sent into a separation stage composed of a heat recovery system followed by high-pressure separation including a recycling compressor and making it possible to separate on the one hand hydrogen, hydrogen sulphide and ammonium hydroxide and on the other hand the effluent supplying a stripper then an atmospheric fractionation column in order to separate the concentrated flows of $H_2S$, naphtha, kerosene, gas oil at the required specification, and an unconverted heavy flow. This unconverted heavy flow is injected into a preheating stage then into a hydrocracking reactor R3 constituting the second hydrocracking stage. This reactor R3 is implemented under the following conditions stated in Table 6:

TABLE 6

| Reactor | | R3 |
|---|---|---|
| Temperature | ° C. | 345 |
| $H_2$ partial pressure | MPa | 12.5 |
| Catalyst | | Metal on amorphous silica-alumina HDK766 |
| HSV | h−1 | 3 |

The catalyst used is a metal catalyst on amorphous silica-alumina of the HDK766 type marketed by the company Axens.

The effluent from R3 is then injected into the high-pressure separation stage downstream of the first hydrocracking stage and recycled. The mass flow rate at the inlet of the reactor R3 is equal to the mass flow rate of the VGO feedstock; a purge corresponding to 2% by mass of the flow rate of the VGO feedstock is taken from the unconverted oil flow at the fractionation bottom.

The distillate cut produced in the hydrocracker and recovered from the fractionation column complies with the Euro V specifications, in particular it has less than 10 ppm by weight of sulphur.

The middle distillates yield of this process is 85% by mass, for an overall conversion of 98% by mass of hydrocarbons the boiling point of which is greater than 380° C.

The total volume of catalyst necessary for this layout is 147 $m^3$.

Example 1 b: Comparative: Co-Treatment of a DSV Feedstock and a Gas Oil Feedstock in a Two-Stage Hydrocracking Process This example is a comparative basic example in which the reactions for hydrocracking VD or VGO and hydrodesulphurization of gas oils (GO) are carried out in a single two-stage hydrocracking process (co-treatment of the two feedstocks)

The hydrocracking unit treats a vacuum distillate feedstock (VGO) in a mixture with a gas oil feedstock (GO) identical to those used in Example 1a). The characteristics of the (VGO) and (GO) feedstocks are given in Table 1.

Main Operating Conditions

The mixture of the two VGO and GO feedstocks is injected into a preheating stage then into a hydrotreating reactor R1 operating under conditions identical to those used in Table 4 in Example 1a).

The effluent from the reactor R1 is then mixed with a hydrogen flow in order to be cooled, then is injected into a second reactor called hydrocracking reactor R2 operating under conditions identical to those implemented in Example 1a) and described in Table 5:

R1 and R2 constitute the first hydrocracker stage, the effluent from the reactor R2 is then sent into a separation stage composed of a heat recovery system followed by high-pressure separation including a recycling compressor and making it possible to separate on the one hand hydrogen, hydrogen sulphide and ammonium hydroxide and on the other hand, the effluent supplying a stripper then an atmospheric fractionation column in order to separate the concentrated flows of $H_2S$, naphtha, kerosene, gas oil at the required specification, and an unconverted heavy flow. This unconverted heavy flow is injected into a preheating stage then into a hydrocracking reactor R3 constituting the second hydrocracking stage. This reactor R3 is implemented under the same conditions as those implemented in Example 1a) and described in Table 6.

The effluent from the reactor R3 is then injected into the high-pressure separation stage downstream of the first hydrocracking stage and recycled. The mass flow rate at the inlet of the reactor R3 is equal to the mass flow rate of the VGO feedstock, a purge corresponding to 2% by mass of the flow rate of the VGO feedstock is taken from the unconverted oil flow at the fractionation bottom.

The distillate cut produced in the hydrocracker and recovered from the fractionation column complies with the Euro V specifications, in particular it has less than 10 ppm by weight of sulphur.

The middle distillates yield of this process is 80% by mass, for an overall conversion of 98% by mass of hydrocarbons the boiling point of which is greater than 380° C.

The total volume of catalyst necessary for this layout is 110 $m^3$.

Example 2: According to the Invention

This example is a layout according to the invention in which the hydrodesulphurization of the gas oils is co-treated with the effluent from the second hydrocracking stage (thus with the hydrocracked UCO). This layout is thus composed of a single two-stage hydrocracker (there is no process dedicated to hydrodesulphurization of gas oil).

The first stage of the process a) is exactly the same as the first stage according to Example 1. R1 and R2 operate on the same pure VGO or VD feedstock described in Table 1 under the same operating conditions stated in Tables 4 and 5.

The effluent from the reactor R2 is then sent into a separation stage b) composed of a heat recovery system followed by high-pressure separation including a recycling compressor (stage c) and making it possible to separate on the one hand hydrogen, hydrogen sulphide and ammonium hydroxide and on the other hand the effluent supplying a stripper then an atmospheric fractionation column (stage d) in order to separate the concentrated flows of $H_2S$, naphtha, kerosene, gas oil at the required specification, and an unconverted heavy liquid fraction (UCO) having a boiling point greater than 380° C. This unconverted heavy flow is injected into a preheating stage then into a hydrocracking reactor R3 constituting the second hydrocracking stage e). This reactor is operated under the following conditions stated in Table 7:

TABLE 7

| Reactor | | R3 |
|---|---|---|
| Temperature | ° C. | 345 |
| $H_2$ partial pressure | MPa | 13 |
| Catalyst | | Metal on amorphous silica-alumina HDK766 |
| HSV | h−1 | 2.8 |

The catalyst used is a metal catalyst on amorphous silica-alumina of the HDK766 type marketed by the company Axens.

The effluent from the reactor R3 is then mixed with a GO feedstock identical to that in Example 1 described in Table 1. This GO feedstock was preheated beforehand by means known to a person skilled in the art, by thermal integration with another flow of the process. The mixture of the effluent from the reactor R3 and the GO feedstock is then injected into a hydrotreating reactor R4 (stage f) the purpose of which is the desulphurization of the GO feedstock. The operating conditions of this reactor are the following, stated in Table 8:

TABLE 8

| Reactor | | R4 |
|---|---|---|
| Temperature | ° C. | 385 |
| $H_2$ partial pressure | MPa | 12.5 |
| Catalyst | | NiMo on alumina HR1058 |
| HSV | h−1 | 5.4 |

The catalyst used is an NiMo catalyst on alumina of the HR1058 type marketed by the company Axens.

The effluent from the reactor R4 (stage f) is then injected into the high-pressure separation stage b) downstream of the first hydrocracking stage a) and recycled. The mass flow rate at the inlet of the reactor R3 is equal to the mass flow rate of the VGO feedstock, a purge corresponding to 1% by mass of the flow rate of the VGO feedstock is taken from the unconverted oil flow at the fractionation bottom.

The distillate cut produced, recovered from the fractionation column, conforms to the Euro V specification, in particular it has less than 10 ppm by weight of sulphur.

The middle distillates yield of this process is 85% by mass, for an overall conversion of 99% by mass of hydrocarbons the boiling point of which is greater than 380° C.

The total volume of catalyst necessary for this layout is 78 $m^3$.

Unexpectedly, implementing the reactor R4 of stage f) under the operating conditions stated allows, with respect to the dedicated processes of Example 1a):

reducing the initial investment and consumption of catalyst in the second hydrocracking stage e), which is reflected in a reduction in the total volume of catalyst necessary for the whole process, and with respect to co-treatment of a VD feedstock and a GO feedstock in a two-stage hydrocracking process:

limiting the cracking of the feedstock of gas oil type in the hydrotreating stage which is reflected in the increase in the middle distillates yield, in addition, desulphurizing the feedstock of gas oil type, minimizing the formation of heavy polyaromatic products (HPNA), which is reflected in limiting the purge at the intake of the second hydrocracking stage and therefore increasing the conversion of the process, and in addition, desulphurizing the feedstock of gas oil type, converting the unconverted part originating from the second hydrocracking stage e), which is reflected in the reduction in the quantity of catalyst used in said hydrocracking stage e), at iso-conversion per pass of the stage constituted by the combination of the second hydrocracking stage e) and the hydrotreating stage f).

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for hydrocracking hydrocarbon-containing feedstock containing at least 20% by volume of compounds boiling above 340° C., said process comprising at least the following:

a) hydrocracking said feedstocks, operating in the presence of hydrogen and at least one hydrocracking catalyst, at a temperature of 250° C. to 480° C. under a pressure of 2 MPa to 25 MPa, at a space velocity of 0.1 h-1 to 6 h-1 and at a quantity of hydrogen introduced such that the volume ratio liter of hydrogen/liter of hydrocarbon is 100 L/L to 2000 L/L, b) gas/liquid separation of effluent originating from a) in order to produce a liquid effluent and a gaseous effluent comprising at least hydrogen, c) compressing the gaseous effluent comprising at least hydrogen before it is recycled into at least hydrocracking a), d) fractionating the liquid effluent from b) into at least one effluent comprising converted hydrocarbon-containing products having boiling points less than 340° C. and into an unconverted liquid fraction having a boiling point greater than 340° C., e) hydrocracking of said unconverted liquid fraction originating from d), operating in the presence of hydrogen and a hydrocracking catalyst at a temperature of 250° C. to 480° C. under a pressure of 2 MPa to 25 MPa, at a space velocity of 0.1 h-1 to 6 h-1 and at a quantity of hydrogen introduced such that the volume ratio liter of hydrogen/liter of hydrocarbon is 100 L/L to 2000 L/L, f) hydrotreating effluent originating from e) in a mixture with a hydrocarbon-containing liquid feedstock comprising at least 95% by weight of compounds boiling at a boiling point of 150° C. to 400° C., said hydrotreating in f) operating in the presence of hydrogen and at least one hydrotreating catalyst, at a temperature of 200° C. to 390° C., under a pressure of 2 MPa to 16 MPa, at a space velocity of 0.2 h-1 to 5 h-1 and at a quantity of hydrogen introduced such that the volume ratio liter of hydrogen/liter of hydrocarbon is 100 L/L to 2000 L/L.

2. The process according to claim 1 in which the hydrocarbon-containing feedstock treated in said process in a) is a hydrocarbon-containing feedstock containing at least 80% by volume of compounds boiling at 370° C. to 580° C.

3. The process according to claim 1 in which the hydrocarbon-containing feedstock treated in said process in a) is a vacuum distillate (VD) that is a gas oil originating from direct distillation of crude or conversion units or distillate originating from desulfurization or hydroconversion of atmospheric residues and/or vacuum residues, deasphalted oils, or feedstocks originating from biomass or a mixture of feedstocks above.

4. The process according to claim 1 in which hydrocracking in a) operates at a temperature of 320° C. to 450° C., under a pressure of 3 MPa to 20 MPa, at a space velocity of 0.2 h-1 to 4 h-1, and at a quantity of hydrogen introduced such that the volume ratio liter of hydrogen/liter of hydrocarbon is 200 L/L to 2000 L/L.

5. The process according to claim 1 in which said hydrocarbon-containing feedstocks treated in said process are hydrotreated before being sent into hydrocracking a), said hydrotreating a) operating in the presence of hydrogen and a hydrotreating catalyst and at a temperature of 200° C. to 400° C., under a pressure of 2 MPa to 16 MPa, at a space velocity of 0.2 h-1 to 5 h-1 and at a quantity of hydrogen introduced such that the volume ratio liter of hydrogen/liter of hydrocarbon is 100 L/L to 2000 L/L.

6. The process according to claim 1 in which purging is carried out on the unconverted liquid fraction having a boiling point greater than 340° C.

7. The process according to claim 1 in which hydrocracking in e) operates at a temperature of 320° C. to 450° C., under a pressure of 3 MPa to 20 MPa, at a space velocity of 0.2 h-1 to 4 h-1, and at a quantity of hydrogen introduced such that the volume ratio liter of hydrogen/liter of hydrocarbon is 200 LL to 2000 L/L.

8. The process according to claim 1 in which the hydrocarbon-containing liquid feedstock used in e) comprises at least 95% by weight of compounds boiling at a boiling point of 150° C. to 380° C.

9. The process according to claim 1 in which hydrocarbon-containing liquid feedstock hydrotreated in f) in a mixture with effluent originating from e) are straight run gas oil, light vacuum gas oil (LVGO), light vacuum distillates, hydrocarbon-containing liquid feedstocks originating from a coking unit from a visbreaking unit, from a steam cracking unit and/or a fluid catalytic cracking unit, or a gas oil feedstock originating from biomass conversion.

10. The process according to claim 1 in which at least a part of effluent originating from hydrotreating in f) is recycled into gas/liquid separation b).

11. The process according to claim 1 in which at least a part of total effluent originating from the hydrotreating in f) is subjected to a second gas-liquid separation in order to produce a liquid effluent and a gaseous effluent comprising at least hydrogen.

12. The process according to claim 11 in which liquid effluent originating from the second separation is recycled into hydrocracking in e) and/or into hydrotreating in f).

13. The process according to claim 11 in which the gaseous effluent comprising at least hydrogen originating from the second separation is sent into compression in c).

14. The process according to claim 11 in which the gaseous effluent comprising at least hydrogen originating from the second separation stage is sent into a second compression and subsequently recycled into e) and/or into f).

15. The process according to claim 9, wherein the hydrocarbon containing liquid feedstock is light cycle oil or light gas oil from a catalytic cracking unit.

16. The process according to claim 1, wherein the hydrocarbon-containing feedstock contains at least 80% by volume of compounds boiling above 340° C.

17. A process for hydrocracking hydrocarbon-containing feedstock containing at least 20% by volume of compounds boiling above 340° C., said process comprising at least the following:

a) hydrocracking said feedstocks, operating in the presence of hydrogen and at least one hydrocracking catalyst, at a temperature of 250° C. to 480° C. under a pressure of 2 MPa to 25 MPa, at a space velocity of 0.1 h-1 to 6 h-1 and at a quantity of hydrogen introduced such that the volume ratio liter of hydrogen/liter of hydrocarbon is 100 L/L to 2000 L/L, b) gas/liquid separation of effluent originating from a) in order to produce a liquid effluent and a gaseous effluent comprising at least hydrogen, c) compressing the gaseous effluent comprising at least hydrogen before it is recycled into at least hydrocracking a), d) fractionating the liquid effluent from b) into at least one effluent comprising converted hydrocarbon-containing products having boiling points less than 380° C. and into an unconverted liquid fraction having a boiling point greater than 380° C., e) hydrocracking said unconverted liquid fraction originating from d), operating in the presence of hydrogen and a hydrocracking catalyst at a temperature of 250° C. to 480° C. under a pressure of 2 MPa to 25 MPa, at a space velocity of 0.1 h-1 to 6 h-1 and at a quantity of hydrogen introduced such that the volume ratio liter of hydrogen/liter of hydrocarbon is 100 L/L to 2000 L/L, f) hydrotreating effluent originating from e) in a mixture with a hydrocarbon-containing liquid feedstock comprising at least 95% by weight of compounds boiling at a boiling point of 150° C. to 400° C., said hydrotreating in f) operating in the presence of hydrogen and at least one hydrotreating catalyst, at a temperature of 200° C. to 390° C., under a pressure of 2 MPa to 16 MPa, at a space velocity of 0.2 h-1 to 5 h-1 and at a quantity of hydrogen introduced such that the volume ratio liter of hydrogen/liter of hydrocarbon is 100 L/L to 2000 L/L.

* * * * *